US006300032B1

(12) United States Patent
Van Damme et al.

(10) Patent No.: US 6,300,032 B1
(45) Date of Patent: Oct. 9, 2001

(54) HEAT-SENSITIVE MATERIAL WITH IMPROVED SENSITIVITY

(75) Inventors: Marc Van Damme, Heverlee; Joan Vermeersch, Deinze, both of (BE)

(73) Assignee: Agfa-Gevaert, Mortsel (BE)

( * ) Notice: Subject to any disclaimer, the term of this patent is extended or adjusted under 35 U.S.C. 154(b) by 0 days.

(21) Appl. No.: 09/495,324

(22) Filed: Feb. 1, 2000

Related U.S. Application Data

(60) Provisional application No. 60/127,153, filed on Mar. 31, 1999.

(30) Foreign Application Priority Data

Feb. 1, 1999 (EP) ..... 99200290

(51) Int. Cl.[7] ..... G03C 1/56

(52) U.S. Cl. ..... 430/188; 430/270.1; 430/302; 430/944

(58) Field of Search ..... 430/164, 188, 430/270.1, 302, 944, 945; 101/453, 467

(56) References Cited

U.S. PATENT DOCUMENTS 5,037,961 * 8/1991 Nuyken et al. ..... 534/558
5,786,128 * 7/1998 Vermeersch et al. ..... 430/302
5,816,162 * 10/1998 Vermeersch ..... 101/467
6,004,727 * 12/1999 Verlinden et al. ..... 430/302
6,096,471 * 8/2000 Van Damme et al. ..... 430/188
6,106,996 * 8/2000 Van Damme et al. ..... 430/271.1
6,110,644 * 8/2000 Vermeersch et al. ..... 430/302
6,162,578 * 12/2000 Zheng et al. ..... 430/270.1
6,214,515 * 4/2001 Van Damme et al. ..... 430/188

FOREIGN PATENT DOCUMENTS 507 008-A1 * 10/1992 (EP) .
771645 5/1997 (EP) .
773112 5/1997 (EP) .
2000-218954-A * 8/2000 (JP) .

* cited by examiner

*Primary Examiner*—Janet Baxter
*Assistant Examiner*—Barbara Gilmore
(74) *Attorney, Agent, or Firm*—Breiner & Breiner, L.L.C.

(57) ABSTRACT

According to the present invention there is provided a heat-sensitive material for making lithographic printing plates comprising on a lithographic support a first image-forming layer comprising a hydrophilic binder, a cross-linking agent for said hydrophilic binder and dispersed hydrophobic thermoplastic polymer particles, and as top image-forming layer a heat switchable image forming layer comprising a heat switchable polymer wherein said top image-forming layer or a layer adjacent to said top image-forming layer comprises a compound capable of converting light into heat, characterized in that said heat switchable polymer is a polymer containing aryldiazosulphonate units.

10 Claims, No Drawings

HEAT-SENSITIVE MATERIAL WITH IMPROVED SENSITIVITY

This application claims the benefit of U.S. Provisional Application No. 60/127,153 filed Mar. 31, 1999.

FIELD OF THE INVENTION

The present invention relates to a heat-sensitive material for preparing lithographic printing plates.

More specifically the invention is related to a processless heat-sensitive material which yields lithographic printing plates with a high sensitivity.

BACKGROUND OF THE INVENTION

Lithographic printing is the process of printing from specially prepared surfaces, some areas of which are capable of accepting ink, whereas other areas will not accept ink.

In the art of photolithography, a photographic material is made imagewise receptive to oily or greasy ink in the photo-exposed (negative working) or in the non-exposed areas (positive working) on a ink-repelling background.

In the production of common lithographic plates, also called surface litho plates or planographic printing plates, a support that has affinity to water or obtains such affinity by chemical treatment is coated with a thin layer of a photosensitive composition. Coatings for that purpose include light-sensitive polymer layers containing diazo compounds, dichromate-sensitized hydrophilic colloids and a large variety of synthetic photopolymers. Particularly diazo-sensitized systems are widely used.

Upon imagewise exposure of such light-sensitive layer the exposed image areas become insoluble and the unexposed areas remain soluble. The plate is then developed with a suitable liquid to remove the diazonium salt or diazo resin in the unexposed areas.

On the other hand, methods are known for making printing plates involving the use of imaging elements that are heat-sensitive rather than photosensitive. A particular disadvantage of photosensitive imaging elements such as described above for making a printing plate is that they have to be shielded from daylight. Furthermore they have a problem of unstable sensitivity with regard to the storage time and they show a lower resolution. The trend towards heat-sensitive printing plate precursors is clearly seen on the market.

For example, Research Disclosure no. 33303 of January 1992 discloses a heat-sensitive imaging element comprising on a support a cross-linked hydrophilic layer containing thermoplastic polymer particles and an infrared absorbing pigment such as e.g. carbon black. By image-wise exposure to an infrared laser, the thermoplastic polymer particles are image-wise coagulated thereby rendering the surface of the imaging element at these areas ink accepting without any further development. A disadvantage of this method is that the printing plate obtained is easily damaged since the non-printing areas may become ink-accepting when some pressure is applied thereto. Moreover, under critical conditions, the lithographic performance of such a printing plate may be poor and accordingly such printing plate has little lithographic printing latitude.

Furthermore EP-A-770 494, 770 495, 770 496 and 770 497 disclose a method for making a lithographic printing plate comprising the steps of (1) image-wise exposing to light a heat-sensitive imaging element comprising (i) on a hydrophilic surface of a lithographic base an image-forming layer comprising hydrophobic thermoplastic polymer particles dispersed in a hydrophilic binder and (ii) a compound capable of converting light to heat, said compound being comprised in said image-forming layer or a layer adjacent thereto; (2) and developing a thus obtained image-wise exposed element by rinsing it with plain water.

The above mentioned heat-sensitive imaging elements for making lithographic printing plates are not optimal regarding sensitivity.

EP-A-771 645 discloses a method for making a lithographic printing plate comprising the steps of:

(1) image-wise exposing an imaging element having on a hydrophilic surface of a lithographic base a photosensitive layer comprising a photosensitive polymer containing aryl-diazosulfonate units;

(2) and developing a thus obtained image-wise exposed imaging element by mounting it on a print cylinder of a printing press and supplying an aqueous dampening liquid and/or ink to said photosensitive layer while rotating said print cylinder.

The sensitivity of such imaging element could be improved.

OBJECTS OF THE INVENTION

It is an object of the present invention to provide a processless heat-sensitive imaging material for making lithographic printing plates having excellent printing properties.

It is a further object of the invention to provide a heat sensitive imaging material for making lithographic printing plates with an improved sensitivity of the imaging material.

Further objects of the present invention will become clear from the description hereinafter.

SUMMARY OF THE INVENTION

According to the present invention there is provided a heat-sensitive material for making lithographic printing plates comprising on a lithographic support a first image-forming layer comprising a hydrophilic binder, a cross-linking agent for said hydrophilic binder and dispersed hydrophobic thermoplastic polymer particles, and as top image-forming layer a heat switchable image forming layer comprising a heat switchable polymer wherein said top image-forming layer or a layer adjacent to said top image-forming layer comprises a compound capable of converting light into heat, characterized in that said heat switchable polymer is a polymer containing aryldiazosulphonate units.

DETAILED DESCRIPTION OF THE INVENTION

A higher sensitivity of an imaging element can be used to an advantage in several ways. First of all, the exposure time of the imaging may be shorter, increasing the output of the imaging apparatus. In a second way, the power of the exposing source may be lower, resulting in an increase of life-time of the exposing source.

A layer which becomes on the one hand more hydrophilic or soluble in water or on the other hand more oleophilic or less soluble in water under the influence of heat is called a heat switchable layer. The compound which is responsible for said switching of polarity is called a heat switchable compound.

The top image-forming layer which becomes more oleophilic under the influence of heat comprises a polymer or copolymer which contains aryldiazosulphonate units.

A heat switchable polymer having aryldiazosulphonate units, also called aryldiazosulphonate resin, preferably is a polymer having aryldiazosulphonate units corresponding to the following formula:

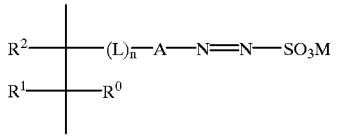

wherein $R^{0,1,2}$ each independently represent hydrogen, an alkyl group, a nitrile or a halogen, e.g. Cl, L represents a divalent linking group, n represents 0 or 1, A represents an aryl group and M represents a cation;

L preferably represents divalent linking group selected from the group consisting of:
—$(X)_t$—$CONR^3$—, —$(X)_t$—COO—, —X—and —$(X)_t$—CO—, wherein t represents 0 or 1, $R^3$ represents hydrogen, an alkyl group or an aryl group, X represents an alkylene group, an arylene group, an alkylenoxy group, an arylenoxy group, an alkylenethio group, an arylenethio group, an alkylenamino group, an arylenamino group, oxygen,sulfur or an aminogroup;

A preferably represents an unsubstituted aryl group, e.g. an unsubstituted phenyl group or more preferably an aryl group, e.g. phenyl, substituted with one or more alkyl group, aryl group, alkoxr group, aryloxy group or amino group;

M preferably represents a cation such as $NH4^+$ or a metal ion such as a cation of Al, Cu, Zn, an alkaline earth metal or alkali metal.

A polymer having aryldiazosulphonate units is preferably obtained by radical polymerisation of a corresponding monomer. Suitable monomers for use in accordance with the present invention are disclosed in EP-A-339 393 and EP-A-507 008. Specific examples are:

M1

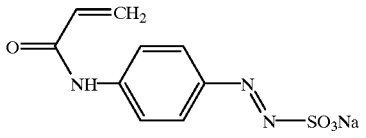

M2

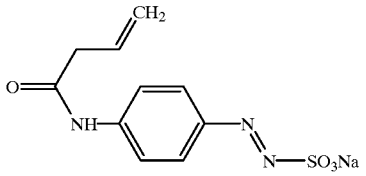

M3

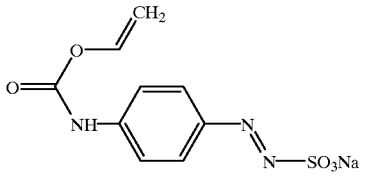

-continued

M4

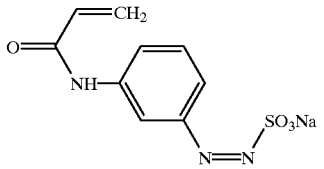

M5

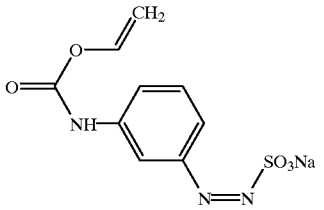

M6

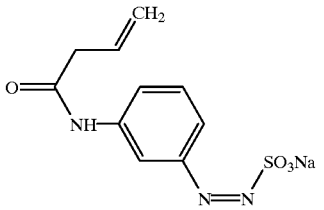

M7

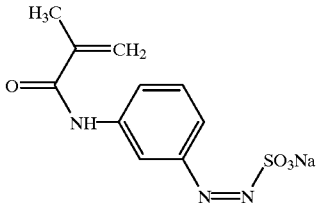

M8

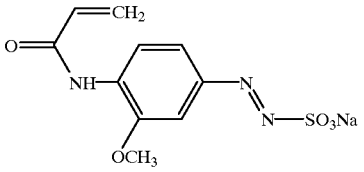

M9

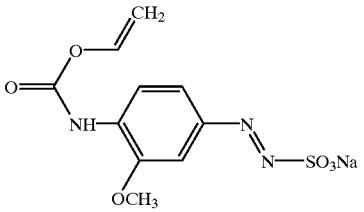

-continued

M10

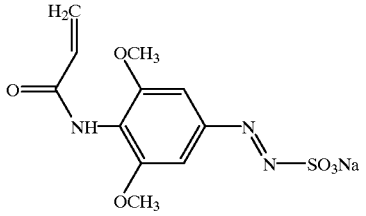

M11

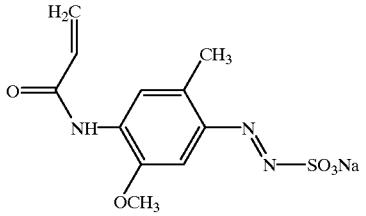

M12

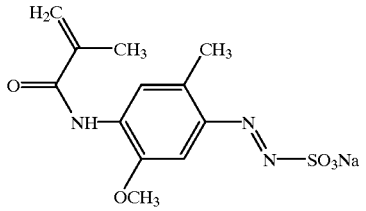

M13

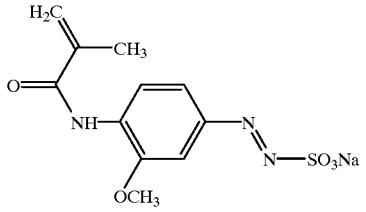

M14

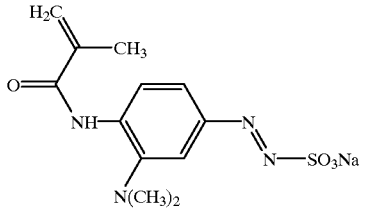

M15

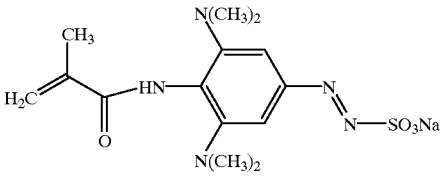

M16

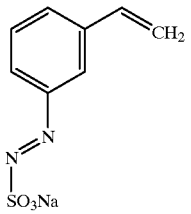

-continued

M17

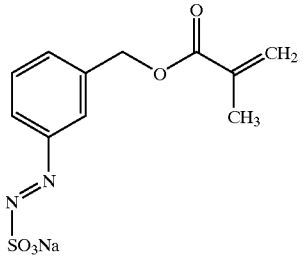

M18

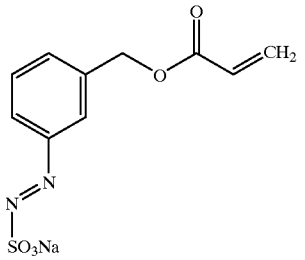

M19

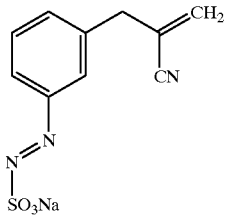

Aryldiazosulphonate monomers, e.g. as disclosed above, can be homopolymerised or copolymerised with other aryldiazosulphonate monomers and/or with vinyl monomers such as (meth)acrylic acid or esters thereof, (meth) acrylamide, acrylonitrile, vinylacetate, vinylchloride, vinylidene chloride, styrene, alpha-methyl styrene etc. In case of copolymers however, care should be taken not to impair the water solubility of the polymer. Preferably, the amount of aryldiazosulphonate comprising units in a copolymer in connection with this invention is between 10 mol % and 60 mol %. According to another embodiment in connection with the present invention, an aryldiazosulphonate containing polymer may be prepared by reacting a polymer having e.g. acid groups or acid halide groups with an amino or hydroxy substituted aryldiazosulphonate. Further details on this procedure can be found in EP-A-507 008.

The top image-forming layer or a layer adjacent to said layer includes a compound capable of converting light into heat. Suitable compounds capable of converting light into heat are preferably infrared absorbing components although the wavelength of absorption is not of particular importance as long as the absorption of the compound used is in the wavelength range of the light source used for image-wise exposure. Particularly useful compounds are for example dyes and in particular infrared absorbing dyes and pigments and in particular infrared absorbing pigments. Examples of infrared absorbing dyes are disclosed in EP-A-97 203 131.4. Examples of infrared absorbing pigments are carbon black, metal carbides, borides, nitrides, carbonitrides, bronze-structured oxides and oxides structurally related to the bronze family but lacking the A component e.g. $WO_{2.9}$. It is also possible to use conductive polymer dispersion such as polypyrrole or polyaniline-based conductive polymer dispersions. Said compound capable of converting light into heat is preferably present in the top image-forming layer but can also be included in the adjacent layer.

Said compound capable of converting light into heat is present in the imaging element preferably in an amount between 1 and 40 % by weight of the total weight of the top image-forming layer, more preferably in an amount between 2 and 30 % by weight of the total weight of the top image-forming layer. The compound capable of converting light into heat is most preferably present in the top image-forming layer in an amount to provide an optical density at a wavelength between 700 nm and 1500 nm of at least 0.35.

The top image-forming layer is preferably applied in an amount between 0.1 and 5 g/m$^2$, more preferably in an amount between 0.5 and 3 g/m$^2$.

According to the present invention to improve sensitivity and throughput and to avoid scumming an imaging element is provided comprising a first image forming layer comprising hydrophobic thermoplastic polymer particles with a preferred average particle size between 40 nm and 150 nm. More preferably the hydrophobic thermoplastic polymer particles are used with an average particle size of 40 nm to 80 nm. Furthermore the hydrophobic thermoplastic polymer particles used in connection with the present invention preferably have a coagulation temperature above 50° C. and more preferably above 70° C. Coagulation may result from softening or melting of the thermoplastic polymer particles under the influence of heat. There is no specific upper limit to the coagulation temperature of the thermoplastic hydrophobic polymer particles, however the temperature should be sufficiently below the decomposition temperature of the polymer particles. Preferably the coagulation temperature is at least 10° C. below the temperature at which the decomposition of the polymer particles occurs. When said polymer particles are subjected to a temperature above the coagulation temperature they coagulate to form a hydrophobic agglomerate in the hydrophilic layer so that at these parts the hydrophilic layer becomes hydrophobic and oleophilic.

Specific examples of hydrophobic polymer particles for use in connection with the present invention have a Tg above 80° C. Preferably the polymer particles are selected from the group consisting of polyvinyl chloride, polyvinylidene chloride, polyacrylonitrile, polyvinyl carbazole etc., copolymers or mixtures thereof. Most preferably used are polystyrene, polymethylmethacrylate or copolymers thereof.

The weight average molecular weight of the polymers may range from 5,000 to 5,000,000 g/mol.

The polymer particles are present as a dispersion in the aqueous coating liquid of the image-forming layer and may be prepared by the methods disclosed in U.S. Pat. No. 3,476,937. Another method especially suitable for preparing an aqueous dispersion of the thermoplastic polymer particles comprises:

dissolving the hydrophobic thermoplastic polymer in an organic water immiscible solvent, dispersing the thus obtained solution in water or in an aqueous medium and removing the organic solvent by evaporation.

The amount of hydrophobic thermoplastic polymer particles contained in the image-forming layer is preferably at least 10% by weight and more preferably at least 15% by weight and most preferably at least 20% by weight of the total weight of said layer.

Suitable hydrophilic binders for use in a first image-forming layer in connection with this invention are water soluble (co)polymers for example synthetic homo- or copolymers such as polyvinylalcohol, a poly(meth)acrylic acid, a poly(meth)acrylamide, a polyhydroxyethyl(meth) acrylate, a polyvinylmethylether or natural binders such as gelatin, a polysaccharide such as e.g. dextran, pullulan, cellulose, arabic gum, alginic acid, inuline or chemically modified inuline.

A cross-linked hydrophilic binder in the first heat-sensitive layer used in accordance with the present embodiment also contains substances that increase the mechanical strength and the porosity of the layer e.g. metal oxide particles having an average diameter of at least 100 nm which are particles of titanium dioxide or other metal oxides. Incorporation of these particles gives the surface of the cross-linked hydrophilic layer a uniform rough texture consisting of microscopic hills and valleys. Particularly preferable is titanium dioxide, used in 50 to 95% by weight of the heat-sensitive layer, more preferably in 60 to 90% by weight of the heat-sensitive layer.

The first image-forming layer also comprises crosslinking agents. such as formaldehyde, glyoxal, polyisocyanate or a hydrolysed tetra-alkylorthosilicate. The latter is particularly preferred.

The first imaging layer preferably contains surfactants which can be anionic, cationic, non-ionic or amphoteric. Perfluoro surfactants are preferred. Particularly preferred are non-ionic perfluoro surfactants. Said surfactants can be used alone or preferably in combination.

The weight of the first imaging layer ranges preferably from 1 to 12 g/m$^2$, more preferably from 3 to 9 g/m$^2$.

The lithographic base according to the present invention can be aluminum e.g. electrochemically and/or mechanically grained and anodised aluminum.

Furthermore in connection with the present invention, the lithographic base can be a flexible support. As flexible support in connection with the present embodiment it is particularly preferred to use a plastic film e.g. substrated polyethylene terephthalate film, polyethylene naphthalate film, cellulose acetate film, polystyrene film, polycarbonate film, polyethylene film, polypropylene film, polyvinyl chloride film, polyether sulphone film. The plastic film support may be opaque or transparent.

Still further also paper or glass of a thickness of not more than 1.2 mm can also be used.

In accordance with the present invention the imaging element is image-wise exposed. During said exposure, the exposed areas are converted to hydrophobic and oleophilic areas while the unexposed areas remain hydrophilic.

Imaging in connection with the present invention is preferably done with an image-wise scanning exposure, involving the use of a laser, more preferably of a laser that operates in the infrared or near-infrared, i.e. wavelength range of 700–1500 nm. Most preferred are laser diodes emitting in the near-infrared. Exposure of the imaging element can be performed with lasers with a short as well as with lasers with a long pixel dwell time. Preferred are lasers with a pixel dwell time between 0.005 $\mu$s and 20 $\mu$s.

In another embodiment of the invention the exposure of the imaging element can be carried out with the imaging element already on the press. A computer or other information source supplies graphics and textual information to the laser via a lead.

The printing plate of the present invention can also be used in the printing process as a seamless sleeve printing plate. This cylindrical printing plate has such a diameter that it can be slided on the print cylinder. More details on sleeves are given in "Grafisch Nieuws" ed. Keesing, 15, 1995, page 4 to 6.

Subsequent to image-wise exposure, the image-wise exposed imaging element can be developed by washing preferably with plain water. The plate is then ready for printing and can be mounted on the press. However, to improve durability it is still possible to bake said plate at a temperature between 200° C. and 300° C. for a period of 30 seconds to 5 minutes. Also the imaging element can be subjected to an overall post-exposure to UV-radiation to harden the image in order to increase the run length of the printing plate.

More preferably the image-wise exposed imaging element after optional wiping is mounted on a print cylinder of a printing press with the backside of the imaging element (side of the support opposite to the side having the photosensitive layer). According to a preferred embodiment, the printing press is then started and while the print cylinder with the imaging element mounted thereon rotates, the dampener rollers that supply dampening liquid are dropped on the imaging element and subsequent thereto the ink rollers are dropped. Generally, after about 10 revolutions of the print cylinder the first clear and useful prints are obtained. According to an alternative method, the ink rollers and dampener rollers may be dropped simultaneously.

Preferably, the photosensitive layer of an image-wise exposed imaging element in accordance with the present invention is wiped with e.g. a cotton pad or sponge soaked with water before mounting the imaging element on the press or at least before the printing press starts running. This will remove some unexposed aryldiazosulphonate resin but will not actually develop the imaging element. However, it has the advantage that possible substantial contamination of the dampening system of the press and ink used is avoided.

An exposed imaging element in accordance with the present invention is preferably mounted on a printing press and used to print shortly after the exposure. It is however possible to store an exposed imaging element for some time in the dark before using it on a printing press to print copies.

Suitable dampening liquids that can be used in connection with the present invention are aqueous liquids generally having an acidic pH and comprising an alcohol such as isopropanol and silica. With regard to dampening liquids useful in the present invention, there is no particular limitation and commercially available dampening liquids, also known as fountain solutions, can be used. The invention will now be illustrated by the following examples without however the intention to limit the invention thereto. All parts are by weight unless stated otherwise.

EXAMPLES

Example 1

The first image-forming layer is coated from water onto a subbed polyester substrate resulting in a thermosensitive crosslinked hydrophilic layer with the following composition: 3.94 g/m$^2$ $TiO_2$ (average particle size 0.3 to 0.5 $\mu$m), 0.44 g/m$^2$ polyvinylalcohol, 2.00 g/m$^2$ hydrolyzed tetramethylorthosilicate and 1.49 g/m$^2$ of a polystyrene latex. After coating the layer was hardened for 7days at 57° C. and 34% R.H.

The azosulphonate layer was coated from methanol on top of the crosslinked first layer resulting in an IR-sensitive layer with the following composition: 0.072 g/m$^2$ of IR-dye 1 and 0.720 g/m$^2$ of a polymer P20 containing 20 mole % of the azosulphonate 1 and 80 mole % of methyl methacrylate.

IR-dye I

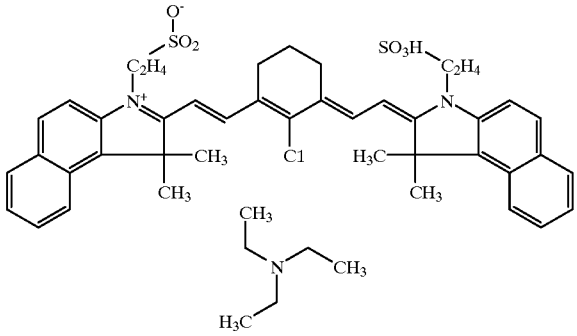

Synthesis of Diazosulphonate Containing Polymer P20

Synthesis of Monomer A

The azogroups containing substances have to be protected from light e.g. by darkening the room or wrapping the flasks with aluminum foil.

The reagents were obtained from Fluka and Aldrich, solvents were distilled before use.

a) preparation of 3 solutions 1 24 g sodium sulfite and 40 g sodium carbonate are dissolved in 250 ml of water 2 15,02 g of p.-aminoacetanilide are diluted in 100 ml water and 36,8 ml concentrated HCl (32%) and cooled to 0–5° C. with a cooling bath.

3 6,8 g sodium nitrite are diluted in 15 ml water

Solution 3 is added dropwise to solution 2 while cooling (below 5° C.), then it is stirred for 10 minutes. After filtration the solution is poured quickly into solution 1 under intensive stirring. Then the solution is stirred for 30 minutes. The solution may be red at the beginning but the colour turns to yellow after some minutes. The solid product is filtered off from the solution and used without further purification.

b)

The product is dissolved in 150 ml water, 8 g NaOH are added, then the solution is heated to 50° C. for one hour and afterwards cooled down to 0° C. While still cooling, 19,66 ml concentrated HCl (32%) are added to the solution. Then 100 ml 1% picrinic acid and a solution of 33,6 sodium carbonate in about 350 ml water are poured into the mixture. Before adding the methacrylic acid chloride the temperature of the solution has to be below 5° C. From a dropping funnel 15 ml of methacrylic acid chloride is very slowly dropped to the solution (heavy foaming). The mixture needs to be stirred for 1 hour at 0–5° C. and after that for another hour at room temperature. Then 300 ml of a saturated solution of sodium acetate are added and the solution is stored in a refrigerator (about 4° C.) overnight. The solid product is filtered and dried for 17 hours at 50° C. under vacuum. To remove inorganic salts the product is dissolved in 150 ml DMF and stirred for at least 2 hours at room temperature and filtered. For precipitation the filtrate is poured into 2 l of diethylether and then filtered. To realize a very low contents of water (2.5%) drying for three days at 50° C. under vacuum is necessary.

Synthesis of the Polymer P 20

Firstly 2.11 g monomer A is diluted in 10 ml of water,3.1 g methyl methacrylate and 0.300 g of azo-bis-isobutyronitrile as well as 40 ml of dioxane are added. In order to remove oxygen, the solution has to be degassed several times. Afterwards the solution (protected from light) is stirred for 17 hours at 70° C. The polymerisation is stopped by adding a small amount of hydroquinone, the solvent is evaporated and the polymer is redissolved in 80 ml methanol. The solution is dropped to 2 l of diethylether and then dried at 50° C. under vacuum over phosphor pentoxide. After drying for 3 days, one obtains a polymer with a water content of 2.5%.

The resulting heat-sensitive material was imaged on a Creo 3244 Trendsetter™ at 2400 dpi, operating at drum speeds of 40, 62, 80 and 112 rpm, and a laser output of 11 Watt.

After imaging the plate was mounted on an AB Dick™ press using K+E 800™ as ink and water with 2% Tame™ as fountain. Subsequently the press was started by allowing the print cylinder with the heat-sensitive material mounted thereon to rotate. The dampener rollers of the press were then dropped on the imaging element so as to supply dampening liquid to the heat-sensitive material and after 10 revolutions of the print cylinder, the ink rollers were dropped to supply ink. After 25 further revolutions clear prints were obtained with no ink-uptake in the non-image parts. An acceptable ink-uptake in the IR-imaged areas was observed at 80 rpm i.e. 242 mJ/cm$^2$.

Comparative Example 1

This comparative example describes the results of a heat-sensitive material corresponding to example 1 but without the presence of the azosulphonate in the top layer.

The first layer was coated in an identical manner as in example 1.

The top layer was coated from methanol on top of the crosslinked first layer with the following composition: 0.072 g/m$^2$ of IR-dye 1.

The resulting heat-sensitive material was imaged and printed as in example 1. An acceptable ink-uptake in the IR-imaged areas was observed at 40 rpm i.e. 485 mJ/m$^2$.

Comparative Example 2

This comparative example describes the results of a heat-sensitive material corresponding to example 1 but without the presence of a first layer i.e. no layer comprising hydrophobic thermoplastic polymer particles in a crosslinked hydrophilic binder.

The first image-forming layer is coated from water onto a subbed polyester substrate resulting in a crosslinked hydrophilic layer with the following composition: 3.94 g/m$^2$ $TiO_2$ (average particle size 0.3 to 0.5 $\mu$m), 0.44 g/m$^2$ polyvinylalcohol, 2.00 g/m$^2$ hydrolyzed tetramethylorthosilicate. After coating the layer was hardened for 7days at 57° C. and 34%R.H.

The azosulphonate layer was coated from methanol on top of the crosslinked first layer resulting in an IR-sensitive layer with the following composition: 0.072 g/m$^2$ of IR-dye 1 and 0.720 g/m$^2$ of a copolymer P20 containing 20% wt of the azosulphonate 1 and 80% wt of methyl methacrylate.

The resulting heat-sensitive material was imaged and printed as in example 1. An acceptable ink-uptake in the IR-imaged areas was observed at 60 rpm i.e.313 mJ/cm$^2$.

What is claimed is:

1. A heat-sensitive material for making lithographic printing plates comprising on a lithographic support a first image-forming layer comprising a hydrophilic binder, a cross-linking agent for said hydrophilic binder and dispersed hydrophobic thermoplastic polymer particles, and as top image-forming layer a heat switchable image forming layer comprising a heat switchable polymer wherein said top image-forming layer or a layer adjacent to said top image-forming layer comprises a compound capable of converting light into heat; wherein said heat switchable polymer is a polymer containing aryldiazosulphonate units.

2. A heat-sensitive imaging element according to claim 1 wherein the amount of aryldiazosulphonate units in said polymer is between 10 mol % and 60 mol %.

3. A heat-sensitive imaging element according to claim 1 wherein said polymer with aryldiazosulphonate units is a copolymer with a monomer selected from the group consisting of (meth)acrylic acid or esters thereof, (meth) acrylamide, acrylonitrile, vinylacetate, vinylchloride, vinylidene chloride, styrene, alpha-methyl styrene.

4. A heat-sensitive imaging element according to claim 1 wherein said aryldiazosulphonate units are substituted aryldiazosulphonate units.

5. A heat-sensitive imaging element according to claim 1 wherein the compound capable of converting light into heat is an infrared absorbing component.

6. A heat-sensitive imaging element according to claim 5 wherein said infrared absorbing component is an infra-red absorbing dye.

7. A heat-sensitive imaging element according to claim 5 wherein said infrared absorbing component is an infra-red absorbing pigment.

8. A method for providing a lithographic printing plate comprising the following steps.

image-wise exposing an imaging element according to claim 1;

developing said exposed imaging element with plain water or an aqueous solution.

9. A method for printing comprising the following steps:

exposing an imaging element according to claim 1;

mounting the exposed imaging on a press;

applying fountain and afterwards or simultaneous ink on the imaging element; and printing from said imaging element.

10. A method for printing comprising the following steps:

mounting an imaging element according to claim 1 on a press;

exposing the mounted imaging element applying fountain and afterwards or simultaneously ink on the imaging element; and printing from said imaging element.

* * * * *

UNITED STATES PATENT AND TRADEMARK OFFICE

CERTIFICATE OF CORRECTION

PATENT NO. : 6,300,032 B1
DATED : October 9, 2001
INVENTOR(S) : Marc Van Damme et al.

It is certified that error appears in the above-identified patent and that said Letters Patent is hereby corrected as shown below:

Column 3,
Line 33, "alkoxr" should read -- alkoxy --.

Column 12, claim 9,
Line 46, after "imaging" insert -- element --.
Line 47, "simultaneous" should read -- simultaneously --.

Column 12, claim 10,
Line 53, start a new paragraph at "applying".

Signed and Sealed this

Fifth Day of March, 2002

*Attest:*

*Attesting Officer*

JAMES E. ROGAN
*Director of the United States Patent and Trademark Office*